United States Patent [19]

Adams

[11] 3,947,136

[45] Mar. 30, 1976

[54] PRESSURE CONTROL MEANS FOR FLUID APPLICATOR

[75] Inventor: Patrick J. Adams, Ada, Ohio

[73] Assignee: Artex Hobby Products, Inc., Lima, Ohio

[22] Filed: Oct. 4, 1974

[21] Appl. No.: 512,158

Related U.S. Application Data

[63] Continuation of Ser. No. 424,630, Dec. 13, 1973, abandoned, which is a continuation of Ser. No. 230,947, March 1, 1972, abandoned.

[52] U.S. Cl. ..... 401/188 A

[51] Int. Cl.[2] ..... B43K 5/02

[58] Field of Search ..... 401/188, 145

[56] References Cited

UNITED STATES PATENTS

| | | | |
|---|---|---|---|
| 2,333,451 | 11/1943 | Sussman et al. | 401/145 |
| 2,787,249 | 4/1957 | Barlow et al. | 401/188 X |
| 3,115,868 | 12/1963 | De Molin et al. | 401/188 |
| 3,181,539 | 5/1965 | Aston | 401/188 |
| 3,256,894 | 6/1966 | Sherman | 401/188 X |

FOREIGN PATENTS OR APPLICATIONS

| | | | |
|---|---|---|---|
| 913,371 | 12/1962 | United Kingdom | 401/188 |

*Primary Examiner*—Lawrence Charles
*Attorney, Agent, or Firm*—Delmar L. Sroufe; Frank B. Pugsley; D. Arlon Groves

[57] ABSTRACT

In combination with a fluid applicator of the fluid marker type, a unitary, self-sealing, one-way check valve for admission and retention of air under pressure to the interior of the applicator, an elastomeric bulb for developing pressure and means for relieving internal pressure.

2 Claims, 5 Drawing Figures

PRESSURE CONTROL MEANS FOR FLUID APPLICATOR

REFERENCE TO PRIOR APPLICATIONS

This is a continuation of application Ser. No. 424,630 filed Dec. 13, 1973, now abandoned, which in turn was a continuation of application Ser. No. 230,947, filed Mar. 1, 1972, now abandoned.

BACKGROUND OF THE INVENTION

The present invention relates generally to fluid applicators and more specifically to applicators of the type known as markers wherein fluid contained in an elongated, cylindrical body is dispensed by capillary action through a porous tip which is in communication with the interior of the container. In such devices, the rate at which the marking fluid or ink is dispensed is determined by the porosity of the tip. Since the porous tip also serves as a seal to block the free flow of fluid from the interior of the applicator, the porousity of the tip must be such that only a relatively low rate of flow is permitted. This means that for certain applications, the tip will dispense too lightly or unevenly. One such application for which the device of the present invention may be used is in the creation and development of artistic works using several different applicators each dispensing a different color ink.

It is the purpose of the present invention to provide a means for controlling flow from a fluid applicator of the type mentioned at selected rates of flow in accordance with particular individual requirements which can be suited to the end use of the applicator.

SUMMARY OF THE INVENTION

The present invention provides an improvement in fluid applicators of the type having a hollow elongated body defining a chamber for containing a quantity of fluid, used for marking purposes and the like, the body having at one end a porous tip in communication with the marking fluid in the conventional manner. The other end of the applicator receives a deformable bulb. The body of the applicator adjacent to the bulb contains a one-way check valve for permitting the passage of a discrete quantity of air from the bulb into the fluid containing chamber. Successive actuations of the bulb can thus build up internal pressure within the body of the applicator to increase the rate of flow of fluid therefrom. In accordance with a further aspect of the invention, means are provided internally of the applicator for permitting external actuation of the adjacent check valve in order to relieve internal pressure within the applicator.

DESCRIPTION OF PARTICULAR EMBODIMENTS

Figure 1:
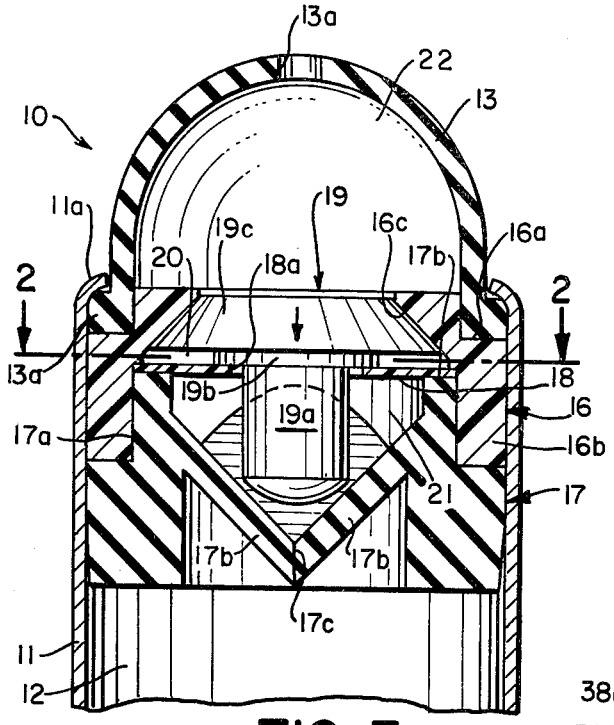
FIG. 1 is a partial, vertical cross section of a fluid applicator having pressure control means in accordance with the principles of the present invention.
Figure 2:
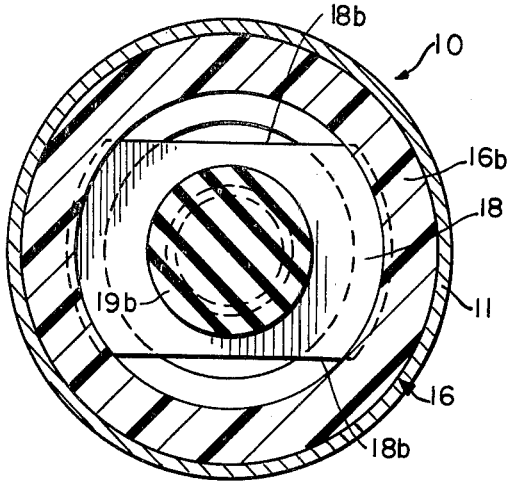
FIG. 2 is a horizontal cross section taken in the direction of arrows 2—2 of FIG. 1.

Referring to the drawing and initially to FIGS. 1 and 2 thereof, a fluid applicator 10 incorporating pressure control means in accordance with the present invention has been illustrated. The applicator 10 has an elongated, hollow cylindrical body 11 designed to fit the hand of the user. At one end (not shown), the applicator 10 includes a porous felt tip in the conventional manner through which a quantity of ink or other marking fluid held within the body 11 can pass for marking or other artistic purposes. The body 11 defines a chamber 12 in the interior thereof for the containment of such ink or marking fluid as is conventional with such fluid applicators generally.

In accordance with the present invention, the end of the body 11 opposite its tip receives an elastomeric bulb 13 having an annular lip **13*a* over which the upper end 11*a* of the body 11 is crimped. A retainer ring 16 is received within the applicator body 11 in close frictional engagement therewith. Ring 16 has an annular cutout 16*a* which in combination with the body 11 and its crimped end 11*a* forms a groove for the reception of the lower edge of bulb 13 and its lip 13*a*. A valve body 17 is closely fitted in frictional engagement with the interior wall of applicator body 11 and defines a circular cutout 17*a* for the reception of a mating, cylindrical section 16*b* of a retainer 16. The valve body further includes downwardly inclined lips 17*b* which meet at a common center 17*c***.

A resilient washer 18 rests upon section **17*d* of the valve body. The washer 18 has a central opening 18*a* therein for the reception of the stem portion 19*a* of a movable valve element 19. The stem 19*a* is integrally connected to a circular flange 19*b* and to a conically shaped valve portion 19*c*. In the position of FIG. 1, valve portion 19*c* is held in sealing engagement with the seat 16*c* of retainer ring 16 due to the upward pressure of washer 18 against flange 19*b*. It will be noted that in the position of FIG. 1, the flange 19*b* rests upon the edge of washer 18 adjacent to the opening 18*a* therein and that a flat annular opening 20 is defined between conical valve portion 19*c* of valve element 19 and the washer 18. Furthermore, as best seen in FIG. 2, the washer 18 is straight along sides 18*b*. Beneath washer 18, above lips 17*b* is a chamber 21 which is in communication with passage 20 past sides 18*b*. The interior of elastomeric bulb 13 defines a chamber 22. Bulb 13 has an opening 13*a* therein interconnecting ambient atmospheric pressure with chamber 22**.

Figure 5:
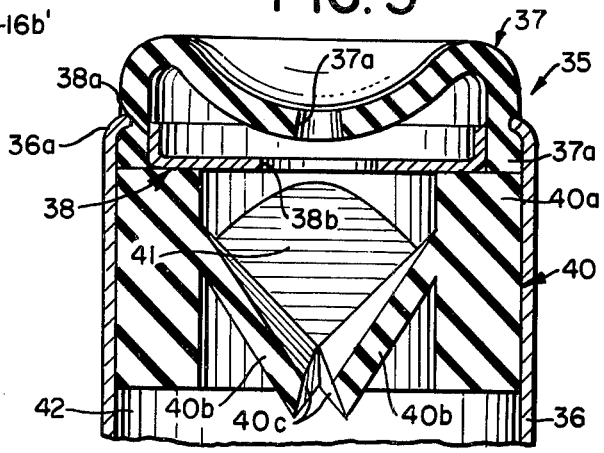
FIg. 5 is a cross section of the embodiment of FIG. 4 showing sequential movement of the pressure control means therein.

The operation of the embodiment of FIG. 1 will now be described. Bulb 13 is pressed inwardly (as illustrated in FIG. 5 with respect to an alternate embodiment), while the user places his thumb over the opening **13*a* therein. Air trapped within chamber 22 will increase in pressure sufficiently to force valve element 19 and portion 19*c* thereof in the direction of the arrow, away from seat 16*c*. Pressurized air may thus pass through passage 20 into chamber 21. Such pressure should ordinarily be great enough to force valve lips 17*b* apart (again see FIG. 5) and a slug of pressurized air will pass into chamber 12. Upon the release of bulb 13, the bulb will return to its position of FIG. 1. Lips 17*b* thereupon resume their contacting position due to their natural resilience but also due to the increased pressure in chamber 12 which acts normal to the lower surface of each lip 17*b* to urge them into sealing contact. Valve element 19 will return to the position of FIG. 1 due to the resilience of washer 18 and due to any pressure which may be trapped in chamber 21. Thus, a primary, one-way check of the air pressure within chamber 12 is formed by valve lips 17***c*, and a secondary check against return flow is effected by valve element 19.

By pressing the bulb 13 a number of times in succession and allowing a new charge of air each time to enter chamber 22, the pressure within chamber 12 can be built up quite rapidly in accordance with the requirements of fluid flow from the applicator. When the user wishes to stop using the applicator, pressure can be relieved from within chamber 12 in the following manner. A pencil point or some similar elongated object may be inserted through opening 13*a* in bulb 13 to press down against the upper surface of element 19 to cause stem 19*a* to thrust valve lips 17*c* apart. Thus, pressure within chamber 12 will be quickly relieved.

Figure 3:
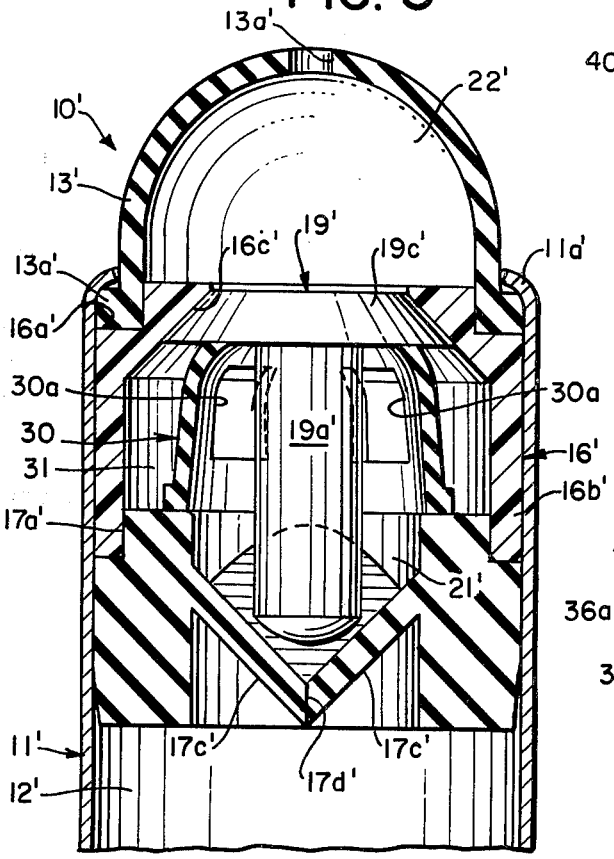
FIG. 3 is a partial, vertical cross section of a second embodiment of the invention.

Referring to FIG. 3, an applicator 10' has been illustrated wherein those parts which are similar to those of the embodiment of FIG. 1 have been indicated by the same but primed reference numerals. The applicator 10' includes a bulb 13' held within an elongated, tubular body 11'. Within the body 11' is a retainer ring 16' and valve body 17' which are fitted together in frictional engagement with the interior of the hollow cylindrical applicator body 11'. Valve body 17' includes depending lips 17*c'* which meet at 17*d'*. A valve element 19' is retained in the position of FIG. 3 through the intermediacy of a deformable, resilient member 30 having spaced cutouts 30*a* therein which communicate with a chamber 31 surrounding member 30 and with a chamber 21' within the valve body. Valve element 19' includes a valve portion 19*c'* which is held in contact with the seat 16*c'* by the upward thrust of member 30. However, when bulb 13' is pressed downwardly, pressure created in chamber 22' will act upon valve element 19' to unseat portion 19*c'* thereof and air will flow from chamber 22' into chamber 31 through openings 30*a* and into chamber 21'. Such pressure will force open lips 17*c'* so that air may flow under pressure into chamber 12' in the same manner as described in connection with the embodiment of FIG. 1. Similarly, the valve element 19' includes a stem 19*a'* which can be used as above-described to force open lips 17*c'* in order to relieve pressure in chamber 12'.

Figure 4:
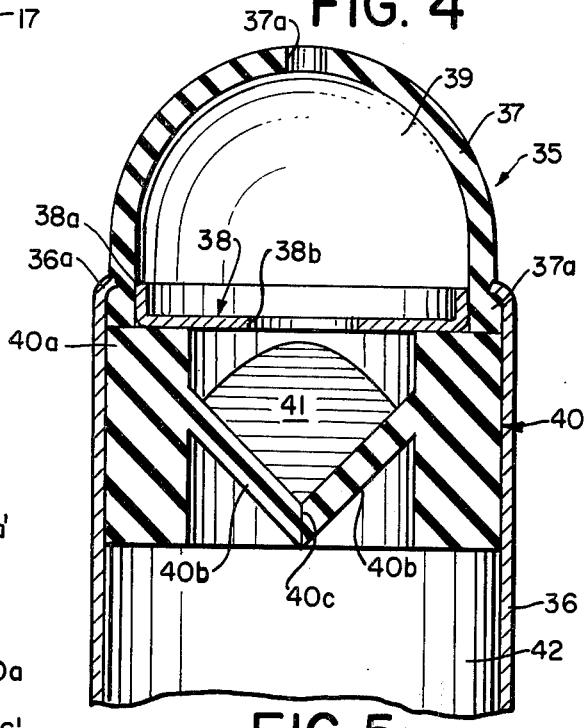
FIG. 4 is a partial, vertical cross section of a third embodiment of the invention.

A third embodiment of the invention has been illustrated in connection with FIGS. 4 and 5. In this embodiment, an applicator 35 includes a tubular body 36 receiving at its upper end an elastomeric bulb 37. The bulb is retained at its lower end 37*a* between the crimped edge 36*a* and a washer 38 having an annular lip 38*a* for this purpose. Washer 38 defines a central opening 38*b* therein and bulb 37 has opening 37*a* therein which communicates with chamber 39 within the bulb. Received in close frictional engagement within the body 36 is a valve body 40 whose upper portion 40*a* abuts the lower end 37*a* of bulb 37 and the lower surface of washer 38. Valve body 40 includes depending valve lips 40*b* which define a slitted orifice 40*c*. Above lips 40*b* and below washer 38 is a chamber 41, while below lips 40*b* is a chamber 42 within the body of the applicator.

As may be seen in connection with FIG. 5, when the bulb 37 is pressed downwardly, air compressed in chamber 39 will flow through opening 38*b* into chamber 41 and will cause lips 40*b* to part in the manner shown. Thus, a slug of pressurized air will be forced into chamber 42 and successive actuation of bulb 37 will build up the pressure within chamber 42 to the desired amount. In the embodiment of FIGS. 4 and 5, the lips 40*b* act as a single seal against the return passage of air from chamber 42 to the atmosphere. Furthermore, in the embodiment of FIGS. 4 and 5, in order to relieve the pressure within chamber 42, an elongated object must be thrust through openings 37*a* and 38*a* directly against lips 40*b* in order to open the seal which they effect.

It will be understood that the foregoing description has related to particular embodiments of the invention and is, therefore representative. In order to appreciate fully the scope of the invention, reference should be made to the appended claims.

I claim:

1. In a fluid applicator having a hollow elongated body defining a chamber for containing a quantity of fluid, said body ending in a tip for the application of said fluid, the improvement comprising:

a. a deformable bulb connected to the other end of said body;

b. internal valve means within said body in communication with said bulb and said chamber, said valve means in turn comprising i. a unitary compressible body section adapted to be inserted into the elongated body and held in position therein;

ii. flexible lips integrally-formed as part of said body section which lips are angularly-disposed to each other and have bevelled ends which engage substantially in a plane in the closed-valve position and which ends separate from said plane in the open-valve position;

iii. said compressible body and said flexible lips cooperating to define the elements of said internal valve means; and c. a second valve member provided between said compressible body and said bulb, said second valve member having means for sealing against return pressure of air from said chamber, said second valve member further including a stem extending toward said valve lips, the end of said stem being disposed adjacent to said lips, said second valve member when moved sufficiently toward said first valve member causing the valve stem thereof to force the valve lips arart to relieve pressure within said chamber.

2. The applicator according to claim 1 wherein a resilient member is interposed between said compressible body and said second valve member, said resilient member defining an opening through which the valve stem extends, the edge of said resilient member bearing against portions of said second valve member to urge said member into a sealing position to block the return flow of air from said chamber.

* * * * *

UNITED STATES PATENT OFFICE

CERTIFICATE OF CORRECTION

Patent No. 3,947,136 Dated March 30, 1976

Inventor(s) Patrick J. Adams

It is certified that error appears in the above-identified patent and that said Letters Patent are hereby corrected as shown below:

Column 1, line 66, "FIg." should be -- FIG. --

Column 2, line 28, "a" should be -- the --

Column 4, line 52, "arart" should be -- apart --

Signed and Sealed this

Twenty-seventh Day of July 1976

[SEAL]

*Attest:*

RUTH C. MASON
*Attesting Officer*

C. MARSHALL DANN
*Commissioner of Patents and Trademarks*